US007571624B1

(12) United States Patent
Clamper

(10) Patent No.: US 7,571,624 B1
(45) Date of Patent: Aug. 11, 2009

(54) MOBILE TEXTILE TREATMENT METHOD AND APPARATUS

(76) Inventor: Steven Clamper, 187 Kirk Dr., Huntington Valley, PA (US) 19008

( * ) Notice: Subject to any disclaimer, the term of this patent is extended or adjusted under 35 U.S.C. 154(b) by 23 days.

(21) Appl. No.: 11/535,026

(22) Filed: Sep. 25, 2006

Related U.S. Application Data

(60) Provisional application No. 60/719,953, filed on Sep. 23, 2005.

(51) Int. Cl.
*D06F 31/00* (2006.01)
*D06F 95/00* (2006.01)

(52) U.S. Cl. ..... 68/3 R; 68/15

(58) Field of Classification Search ..... 68/3 R, 68/15
See application file for complete search history.

(56) References Cited

U.S. PATENT DOCUMENTS

| | | | | |
|---|---|---|---|---|
| 808,083 | A | 12/1905 | Groom | |
| 1,568,789 | A | 1/1926 | Williams | |
| 1,721,105 | A | 7/1929 | Dotterweich | |
| 2,852,306 | A | 9/1958 | Skipp | |
| 3,317,142 | A | 5/1967 | Casale | |
| 3,380,658 | A | 4/1968 | Stasz et al. | |
| 3,481,544 | A | 12/1969 | Jackson | |
| 3,504,858 | A | 4/1970 | Liddiard | |
| 3,685,535 | A | 8/1972 | Cable et al. | |
| 3,720,226 | A * | 3/1973 | Minich | 137/334 |
| 3,736,774 | A | 6/1973 | Shibata | |
| 4,158,248 | A | 6/1979 | Palmer | |
| 4,781,041 | A | 11/1988 | Fowler | |
| 4,797,128 | A | 1/1989 | Fowler | |
| 4,862,551 | A | 9/1989 | Martinez et al. | |
| 5,165,139 | A | 11/1992 | Oxman | |
| 5,437,296 | A | 8/1995 | Citino | |
| 5,469,598 | A | 11/1995 | Sales | |
| 5,607,652 | A | 3/1997 | Hellmuth et al. | |
| 6,240,585 | B1 | 6/2001 | Praechter et al. | |
| 6,571,805 | B2 | 6/2003 | Hoenisch et al. | |
| 6,613,155 | B2 | 9/2003 | Clark | |

(Continued)

FOREIGN PATENT DOCUMENTS

| | | |
|---|---|---|
| EP | 0839945 B1 | 5/1998 |

(Continued)

OTHER PUBLICATIONS

Electronic translation of JP 09-002132A.*

(Continued)

*Primary Examiner*—Joseph L Perrin
(74) *Attorney, Agent, or Firm*—Gerry J. Elman; Elman Technology Law, P.C.

(57) ABSTRACT

The present invention provides a mobile textile treatment system comprising service equipment including, but not limited to, a wet cleaner machine, a reclaimer, a pressing machine and a puff iron contained within the cargo box of a vehicle. The wet cleaner has a cold water supply and a hot water supply, the latter of which is heated by a boiler system, which may include a heat exchanger valve. Additionally, additive tanks store various additives used in the cleaning process. These additives may include cleaning detergent, sizing agent, softener, optical brightener, flame retardant and sanitizing agents. A scalable system may include multiple mobile cargo boxes, each having multiple instances of at least one of the aforesaid machines.

14 Claims, 12 Drawing Sheets

U.S. PATENT DOCUMENTS

2004/0187898 A1* 9/2004 Chen ..... 134/58 D

FOREIGN PATENT DOCUMENTS

| | | | |
|---|---|---|---|
| JP | 05-185870 | | 7/1993 |
| JP | 09-002132 | | 1/1997 |
| JP | 09002132 A | * | 1/1997 |
| JP | 2000042300 A | | 2/2000 |
| JP | 2000051594 A | | 2/2000 |
| JP | 2000051595 A | | 2/2000 |
| JP | 2000051596 A | | 2/2000 |
| JP | 2000051597 A | | 2/2000 |
| JP | 2000051598 A | | 2/2000 |
| JP | 2000051599 A | | 2/2000 |
| JP | 2000051600 A | | 2/2000 |

OTHER PUBLICATIONS

Electronic translation of EP 839945A2.*

* cited by examiner

MOBILE TEXTILE TREATMENT METHOD AND APPARATUS

CROSS REFERENCE TO RELATED APPLICATIONS

This application claims benefit to U.S. Provisional Application Ser. No. 60/719,953, filed on Sep. 23, 2005, the disclosure of which is incorporated herein by reference in its entirety.

FIELD OF THE INVENTION

The present invention relates generally to a textile cleaning and treatment method and apparatus. More specifically, the present invention relates to a textile cleaning and treatment method and apparatus that is suitable for use as a mobile textile treatment system.

BACKGROUND

Hospital beds are generally surrounded by a curtain, referred to as a "cubicle curtain." These curtains can harbor bacteria and other unwanted germs. It is therefore critical to thoroughly sanitize these curtains to reduce the risk of spreading disease. Because the cleaning equipment is specialized, most hospitals are forced to send the garments to an offsite facility for cleaning. This can be expensive, and adds delays due to the time required to transport the textiles to and from the cleaning facility. Therefore, what is needed is a means to properly clean textiles such as cubicle curtains in a thorough, yet efficient and economical manner.

SUMMARY OF THE INVENTION

The present invention provides an apparatus and method for textile cleaning and treatment. In particular, the apparatus is provided in a mobile configuration. In this way, the textiles are cleaned "on site," eliminating the time and expense of transporting the textiles to an offsite facility for cleaning.

The particular aspects of the present invention, both an apparatus and a method for servicing textiles are set forth as follows. The present invention provides a mobile textile treatment system comprising service equipment including, but not limited to, a scale, a wet cleaner machine, a reclaimer, a pressing machine and a puff iron contained within the cargo box of a vehicle. The wet cleaner has a cold water supply and a hot water supply, the latter of which is heated by a boiler system. Additionally, a plurality of additive tanks store various additives used in the cleaning process. These additives may include, but are not limited to, cleaning detergent, sizing agent, softener, optical brightener, flame retardant and sanitizing agents.

The textile sanitizing agent is of particular pertinence when used in the treatment of contaminated textiles of a healthcare facility. A sanitizing agent typically eliminates at least 99.9% of infectious bacteria, particularly *Staphylococcus aureus* and *Klebsiella pneumoniae*, and renders the textile bacteriostatic and self-sanitizing for thirty (30) days. It also protects the textile against cross-contamination. A currently preferred sanitizing agent is a quaternary ammonium compound, for example BacStop™, provided by Edmar Chemical Company (U.S. EPA Register No. 7048-08).

A further aspect of the mobile textile cleaning system is a boiler system which is comprised of a return tank, a boiler, and a boiler control computer. The return tank has a connection to a pressurized water source, as well as a pressure sensor.

The pressure sensor is interfaced to the boiler control computer. There also exists an electrically controllable valve inline with the connection to the pressurized water source. The controllable valve is also interfaced to the boiler control computer, wherein the boiler control computer opens the controllable valve when a reading from the pressure sensor falls below a predetermined level, and closes the controllable valve when a reading from the pressure sensor exceeds a predetermined level, thereby maintaining a desired pressure level in the return tank. Another aspect of the boiler system is an air trace which has an air intake outside the cargo box, connected to the boiler, and which reduces noise.

The wet cleaner machine, a further aspect of the mobile textile cleaning system service equipment, has a plurality of locking ports and a corresponding plurality of locking bars. The locking bars are inserted into the locking ports, thereby stabilizing the wet cleaner machine during transport. The wet cleaner is connected to a return system and a pump, the return system comprising at least one return tank, the return tank connected to the wet cleaner, the return tank mounted higher than the wet cleaner, whereby the pump pumps liquid from the wet cleaner to the return tank, and the liquid returns to the wet cleaner by gravity means.

The vehicle used to transport the mobile textile treatment system is comprised of a chassis having a plurality of longitudinal rails connected by a plurality of cross members, each of the cross members having a conduit groove, thereby providing a place for routing pipes.

Further, the mobile textile treatment system is comprised of an intake pump which feeds a pressurized water source and in turn supplies the water to the wet cleaner.

Another aspect of the present invention is a method for servicing contaminated textiles. In one embodiment of this method, the steps are as follows: (a) transporting a mobile textile treatment system onto premises of a facility requiring service of contaminated textiles, the mobile textile treatment system comprising service equipment for cleaning, treating with additives, drying and pressing textiles; (b) removing contaminated textiles from the facility requiring service to the mobile textile treatment facility; (c) operating the service equipment to clean, treat with additives, dry and press the textiles of the facility; (d) returning the serviced textiles to the facility; and (e) transporting the mobile textile treatment system away from the premises of the facility.

One aspect of the embodiment of this particular method is operation of a wet cleaner machine for use with hot and cold water. The hot water is provided by a boiler system attached to a propane tank. Steam produced by the boiler system passes through a heat-exchanging valve to create hot water for the wet cleaner machine. An air trace is part of the boiler system and functions to reduce noise production during servicing.

An additional feature of this particular embodiment is an additive injection system comprised of a plurality of tanks filled with additives for injection into the wet cleaning machine. The additives may include, without limitation: cleaning detergent, sizing agent, softener, optical brightener, flame retardant, and/or sanitizing agent. A preferred sanitizing agent is BacStop™, a fabric sanitizer for rendering the textile bacteriostatic and self-sanitizing for 30 days and protecting the textile against cross-contamination, as mentioned above.

The operation of the service equipment as set forth above in step (c) of this method may be further comprised of the following substeps: (c1) weighing contaminated textiles; (c2) adding contaminated textiles to wet cleaner machine with hot and cold water; (c3) operating additive injection system to provide additives to contaminated textiles; (c4) operating wet cleaner machine to clean contaminated textiles; (c5) removing water from wet cleaner machine through a button trap; and either step (c6-a) storing, in a return system tank, removed water for subsequent use in wet cleaner machine or step (c6-b) draining removed water from the button trap to outside of the mobile textile treatment system.

Once cleaned, the textiles are removed from the wet cleaner machine and loaded into the reclaimer to remove moisture from cleaned textiles. From the reclaimer, the cleaned textiles are placed on a pressing machine and a puff iron, both of which may be operated to remove wrinkles from the textiles before being returned to the facility which required such service.

Desirably, embodiments of the present invention include interlocks to prevent operation of the boiler and wet cleaner while the truck is in motion.

In one embodiment of this method, the mobile textile treatment system is comprised of a single vehicle for transporting the mobile textile treatment system; in another it is comprised of multiple vehicles for transporting the mobile textile treatment system. A further aspect is that the mobile textile treatment system desirably further comprises diesel generating equipment to provide electricity for powering the service equipment.

In yet another embodiment of an aspect of this invention, the steps for servicing contaminated textiles would begin with the transportation of the mobile textile treatment system onto the premises of a healthcare facility, which might be a hospital or nursing care facility although other such facilities could also utilize this service. Further, the contaminated textile might be comprised of cubicle curtains from a healthcare facility.

The present invention also provides an improved method of textile cleaning. The method considerably reduces the time required to complete a washing cycle. Typically, a conventional cleaning cycle takes approximately 45 minutes. With the system of the present invention, a cleaning cycle may take as little as 15 minutes.

As mentioned previously, another feature of the present invention is the application of an antimicrobial agent to the textile as part of the cleaning process. This provides additional protection for the textiles after they are reinstalled in the facility. These, and other advantages will be apparent from the drawings and detailed description that follow.

DETAILED DESCRIPTION

Figure 1:
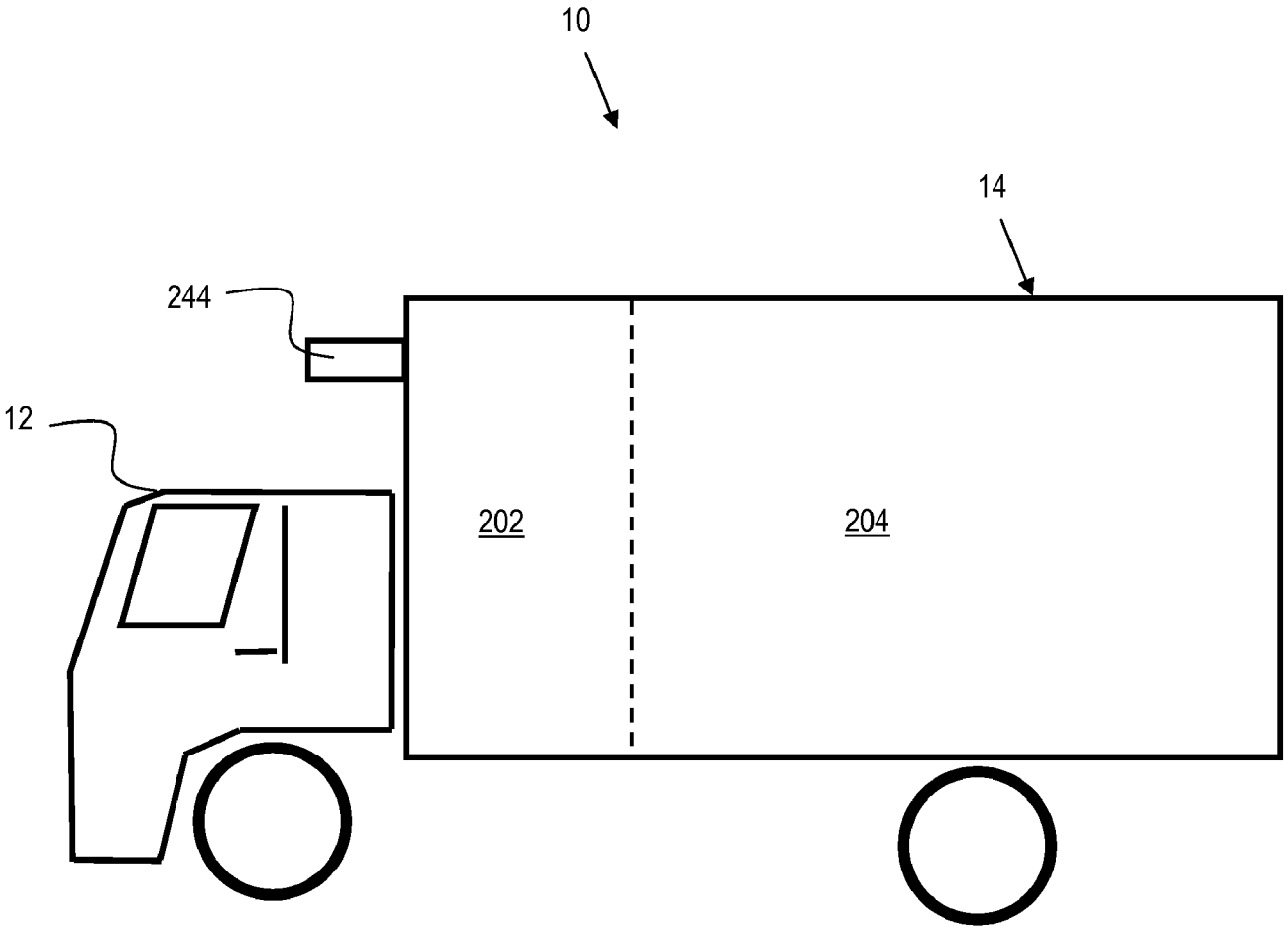
FIG. 1 shows a schematic elevation view of a truck embodying the mobile textile treatment system of the present invention.
Figure 2:
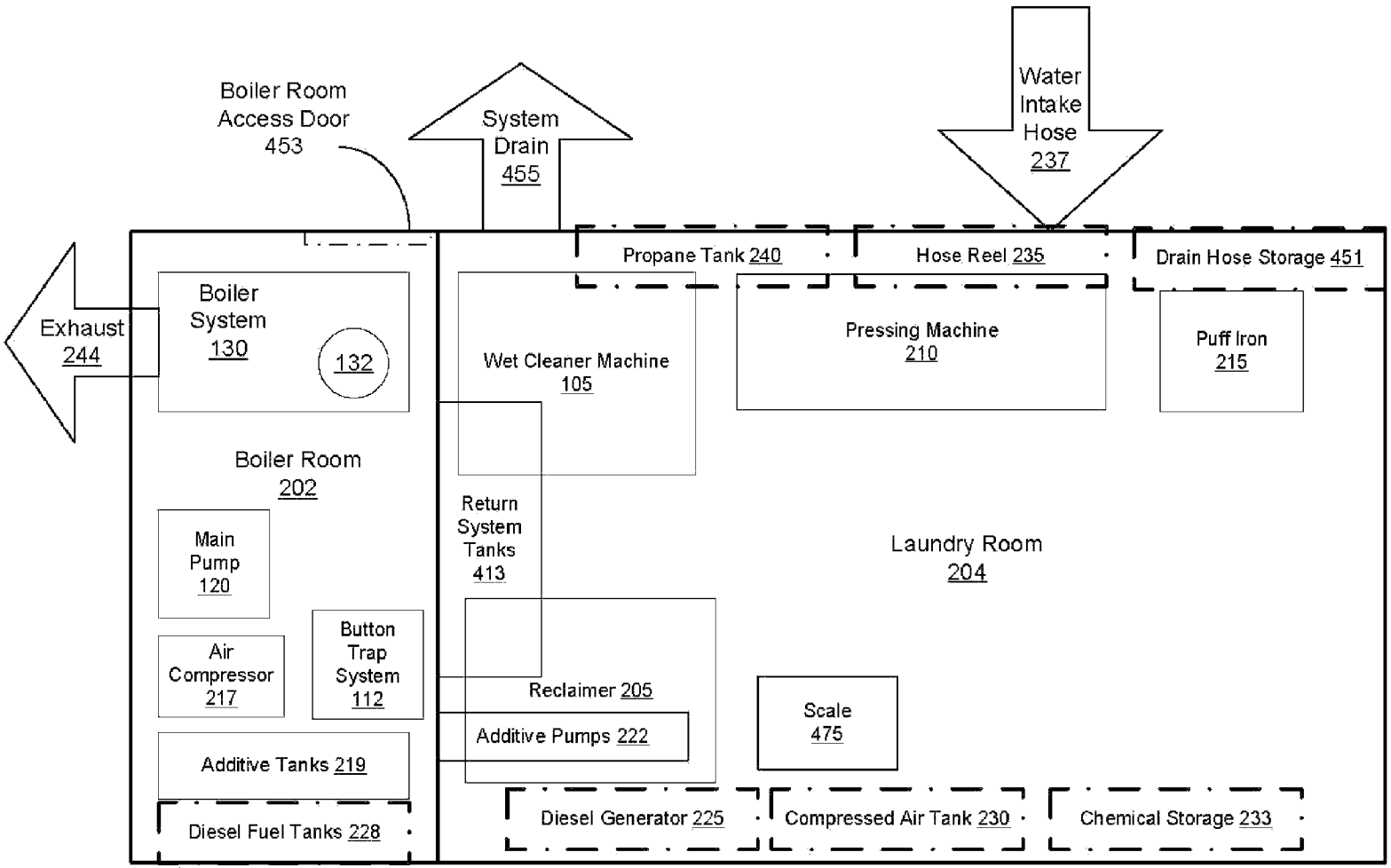
FIG. 2 shows a schematic plan view of a general layout of the box portion of the mobile textile treatment system of the present invention.

FIGS. 1 and 2 show an embodiment of the apparatus of the present invention. The mobile textile treatment system 10 is implemented in, for example, a 26-foot box truck. The truck has a cab portion 12 and box portion 14. The box portion 14 is divided into two rooms, a boiler room 202, and a laundry room 204. In the boiler room 202 is boiler system 130, the exhaust from which is vented out of the boiler room 202 to the outside via exhaust vent 244.

Laundry room 204 is desirably accessed through a door (not shown) in the rear of box 14. Boiler room 202 is accessed through boiler room access door 453 on the side of box 14. The laundry room 204 contains various cleaning equipment including Wet Cleaner Machine (wet cleaner) 105, Reclaimer 205, Pressing Machine 210 and Puff Iron 215. These machines are used to clean dirty textiles, allowing them to be returned to service rather than discarded. Scale 475 is desirably used for weighing the textiles prior to placing them in wet cleaner machine 105. By knowing the weight, an operator can set appropriate parameters for proper treatment. These parameters may include, but are not limited to, the amount of detergent and additives, the length of cleaning and treatment cycles, and the amount of water used.

A boiler room 202 at the forward section of the box 14 houses the boiler system 130, main pump 120, and air compressor 217. A plurality of additive tanks 219 store various additives used in the cleaning process. These additives may include, but are not limited to, cleaning detergent, sizing, softener, optical brightener, flame retardant and sanitizing agent. The Wet Cleaner 105 cleans textiles using multiple cycles during the cleaning process. The cycles may include a soak cycle, one or more wash cycles, rinse cycles, and treatment cycles, as well as other operational cycles. The term "cleaning process" refers to an entire set and sequence of cycles required to clean a textile, such as a curtain. Different types of textiles typically are subjected to different cleaning processes in accordance with the present invention.

A plurality of additive pumps 222 provide the additives to Wet Cleaner 105 during the wash or treatment cycles as required. For the purposes of this disclosure, the liquid used during a wash cycle is referred to as "washing liquid." Similarly, liquid used during a treatment cycle is referred to as "treatment liquid," and liquid used during a rinse cycle is referred to as "rinsing liquid."

Underneath the box 14 there are various other components of the mobile cleaning system 10. Diesel fuel tank 228 provides fuel to diesel generator 225. The diesel generator provides electricity for the cleaning equipment. Some of the cleaning equipment typically operates on 3-phase power, so a diesel generator that is to be used with such equipment must be capable of generating that. Optionally, one or more power input connecters may be provided. In this case, if the facility can provide the needed electrical power, the diesel generator on board the mobile cleaning system 10 is not required to operate, thereby conserving diesel fuel.

Compressed Air Tank 230 provides a reserve of pressurized air, and is recharged by air compressor 217 when necessary. A chemical storage compartment 233 provides storage for some of the cleaning supplies.

Hose reel 235 is motorized, and provides an extendable water intake hose 237 to attach to an external water supply provided by the facility at the premises where the cleaning is to take place. The water intake hose 237 provides water to main pump 120. Preferably, the water is passed through intake filter 115 before entering main pump 120.

Propane tank 240 is preferably double walled, making it well suited for mobile applications. The propane is used by boiler system 130 to provide steam. As mentioned previously, the exhaust from boiler system 130 is then vented out of the boiler room 202 to the outside via exhaust vent 244. The steam is piped through a heat-exchanging valve 132 to heat water, which is then used to operate the wet cleaner machine 105. The use of steam to heat water for the wet cleaner 105 is a particular advantage of preferred embodiments of the present invention.

In typical usage, washing liquid or treatment liquid from the wet cleaner 105 is routed to button trap 112 upon completion of the washing cycle. The button trap system 112 includes a pump (not separately shown) that pumps the liquid to the return system 110, which comprises return tank(s) 413. The washing liquid and/or treatment liquid can then be used for multiple laundry loads, thereby conserving it.

When the mobile cleaning system 10 is in transit, a drain hose is stored in drain hose storage 451. During the cleaning operation, the drain hose is connected to system drain 455. Typically, the drain hose routes waste liquid to a sanitary drain for proper disposal.

Figure 3A:
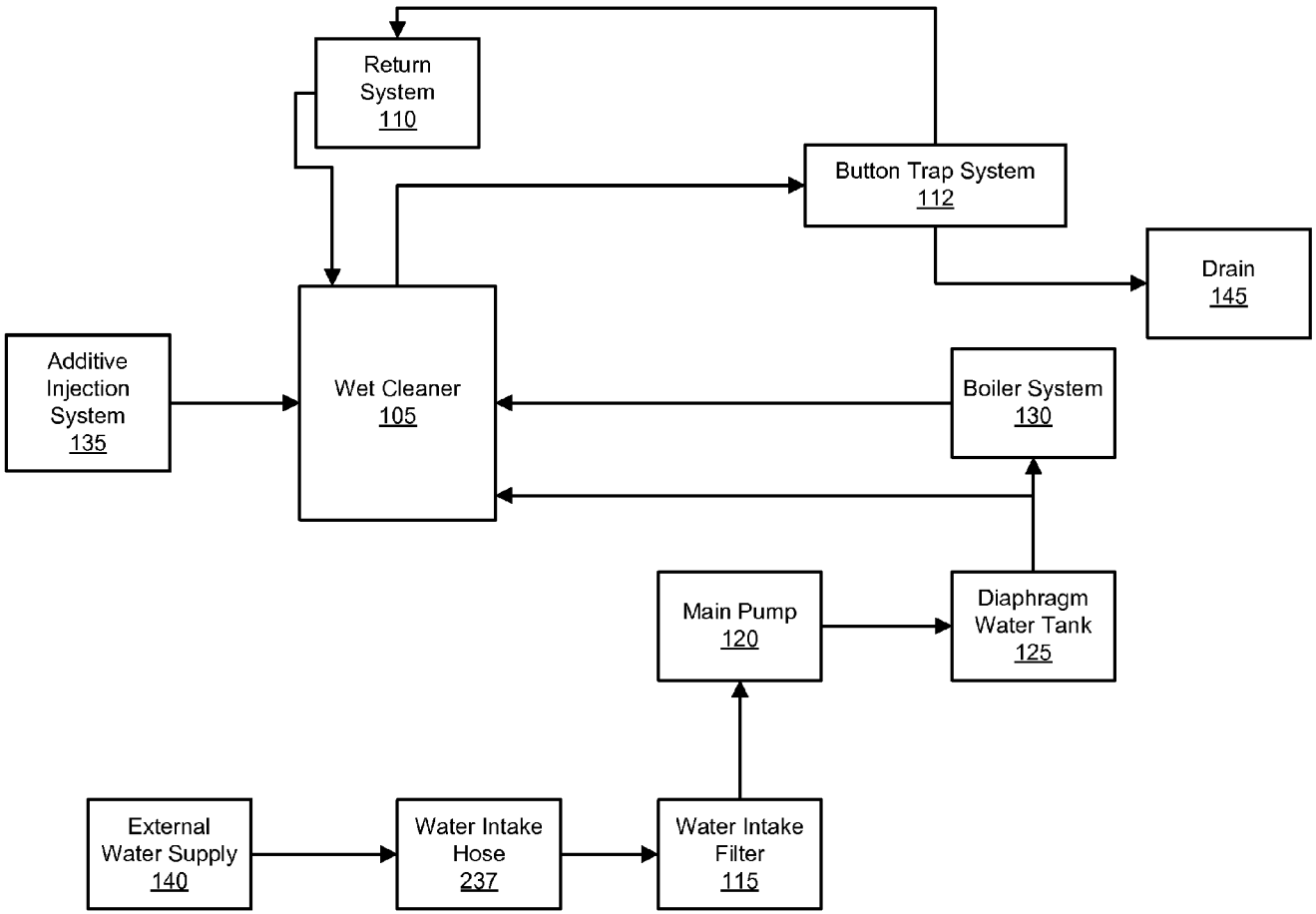
FIG. 3A and FIG. 3B show block diagrams illustrating the relationship between various functional units of the wet cleaning system of the present invention.

FIG. 3A is a block diagram showing the flow of fluids in a wet cleaning system of the present invention. External water supply 140 supplies water to the mobile cleaning system 10. The water is passed via water intake hose 237 through water intake filter 115 and then driven via main pump 120. The water is pumped into diaphragm water tank 125, and pressurized to approximately 120 psi. This high pressure allows the wet cleaner 105 to be filled at a much faster rate than if it were simply connected to a water main from the local municipal water supply. The accelerated fill times provided by the present invention greatly reduce the time required to process the textiles. A reduction of processing time from 45 minutes to 15 minutes has been observed using a preferred embodiment.

From diaphragm tank 125, some water is routed to the wet cleaner 105 as cold water. Some water is routed from diaphragm tank 125 to boiler system 130 for heating, and then provided to wet cleaner 105 as hot water. Desirably the boiler system 130 includes a heat exchanger valve 132 (see FIG. 2) which efficiently extracts heat from steam in the boiler to heat the water directed into the wet cleaner 105. Once the proper amount of water at the desired temperature is in wet cleaner 105, the wet cleaner continues the cleaning cycle, supplying additives as needed to the wet cleaner via additive injection system 135. After the washing cycle, washing liquid is routed to button trap system 112. From there, it may be reused, or sent to drain 145, at which point, the washing liquid exits the mobile cleaning system 10.

Button trap system 112 includes a pump (not separately shown) that pumps the washing liquid to the return system 110. The washing liquid can then be reused. The same process applies to treatment liquid that is used during a treatment cycle. A typical treatment cycle may include the application of a fire retardant. In this case, a fire retardant liquid is applied to textiles in wet cleaner 105 during a treatment cycle. After the cycle is complete, the treatment liquid passes through button trap system 112, and is then pumped to return system 110 to be used again.

Figure 3B:
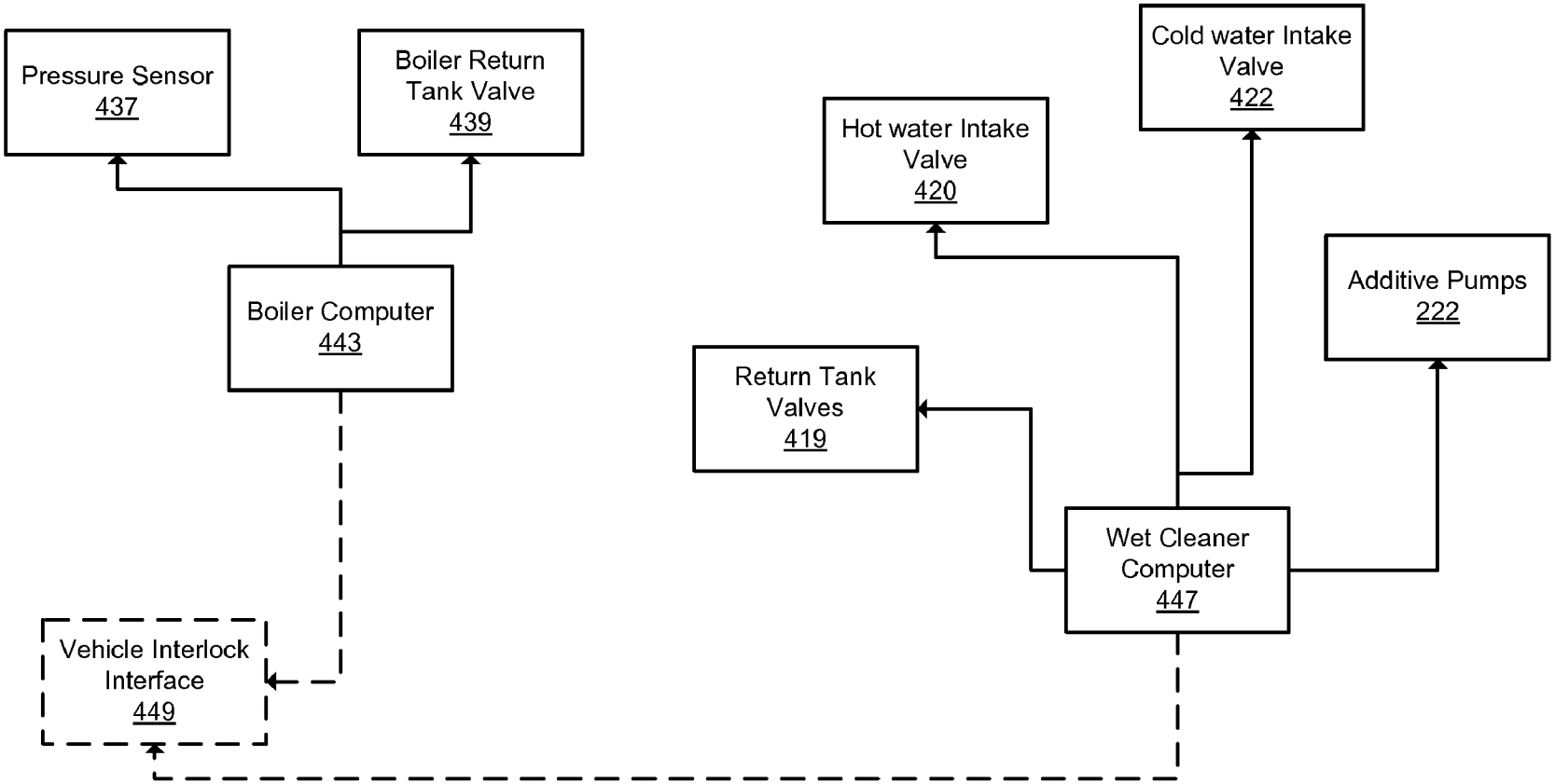

FIG. 3B shows a block diagram of a control system for a wet cleaner of the present invention, indicating the critical sensors, valves and pumps that are under computer control. The wet cleaner computer 447 controls the input of hot and cold water into the wet cleaner 105 via a hot water intake valve 420, and a cold water intake valve 422. The wet cleaner computer 447 also controls the additive pumps 222, allowing a specific additive to be added at the appropriate time during the cleaning cycle. Typically, the liquid for the rinse cycle will come from the return system tanks 413 (see FIG. 2), and the wet cleaner computer 447 will open the return tank valves 419 at the appropriate time to allow the rinse liquid to enter the wet cleaner 105.

Boiler control computer 443 monitors pressure sensor 437, and activates valve 439 to maintain pressure and water at desired levels within the boiler return tank. Signals from the boiler control computer 443 and wet cleaner computer 447 may optionally be connected to a vehicle interlock interface 449. This prevents operation of the vehicle when conditions are unsafe. For example, if the wet cleaner 105 is operating, the user can be prevented from putting the vehicle into a drive gear. A similar scenario can apply to the boiler computer 443. If the boiler 431 (see FIG. 5) is operating, driving the vehicle can be prevented. Similarly, if the vehicle is currently in a drive gear, the wet cleaner 105 and boiler 431 can be prevented from starting, a safety feature of the present invention.

Figure 4:
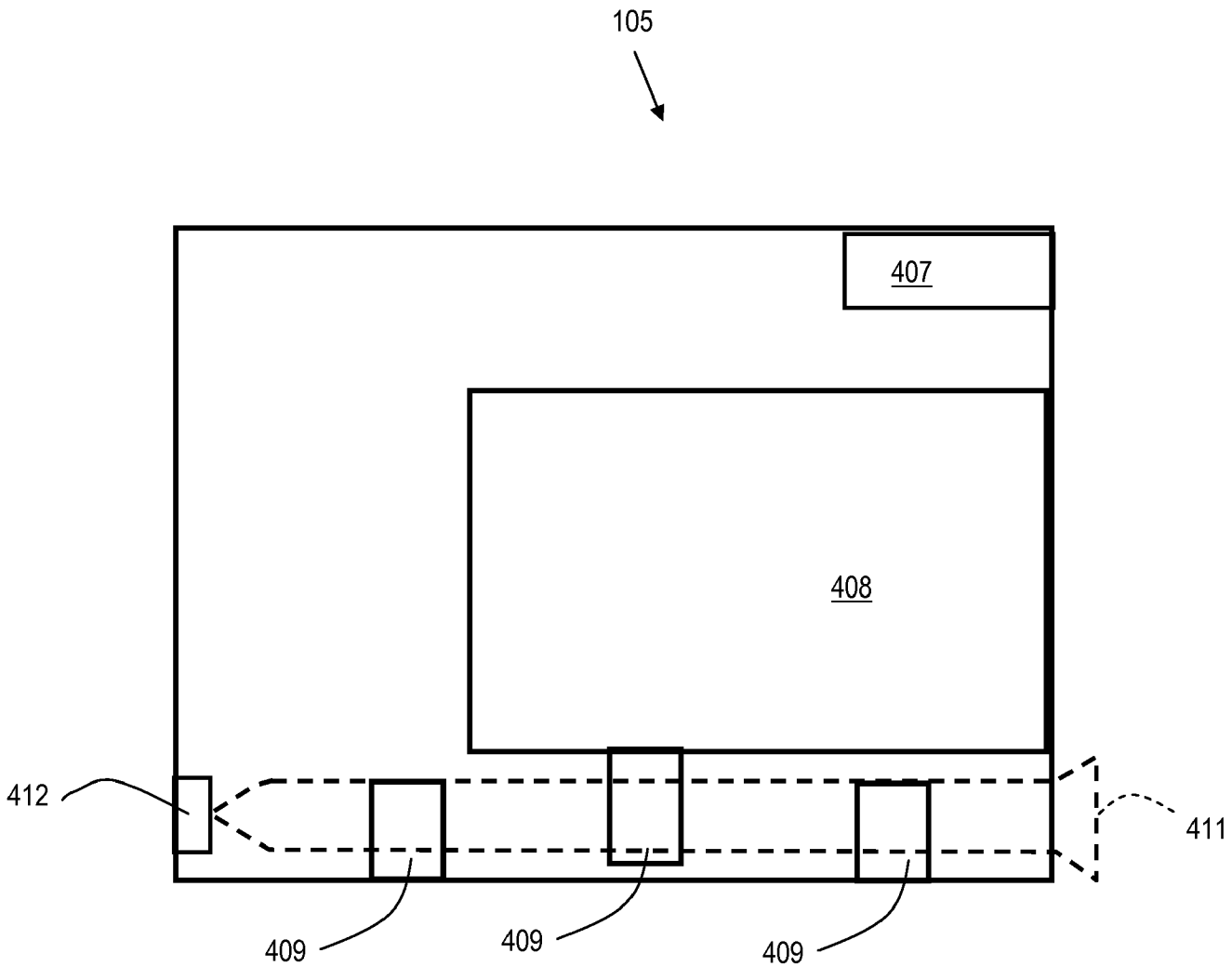
FIG. 4 shows a schematic elevation view of a wet cleaner machine employed in an embodiment of the present invention.

FIG. 4 shows a side view of the wet cleaner 105. The wet cleaner 105 has an internal computer 407, which desirably provides a panel-based user interface. The wet cleaner 105 needs to be secured during transport. This is accomplished via a plurality of locking ports 409. During transport, a locking bar 411 is placed through each locking port 409. This reduces motion of the wet cleaner drum 408 during transport. Interlock switch 412 provides a signal to internal computer 407 when locking bar 411 makes contact with interlock switch 412. When the signal is asserted, internal computer 407 prevents operation of wet cleaner 105. This serves as an interlock mechanism to prevent operation of wet cleaner 105 when locking bar 411 is inserted into wet cleaner 105, a further safety feature of the present invention.

Figure 5:
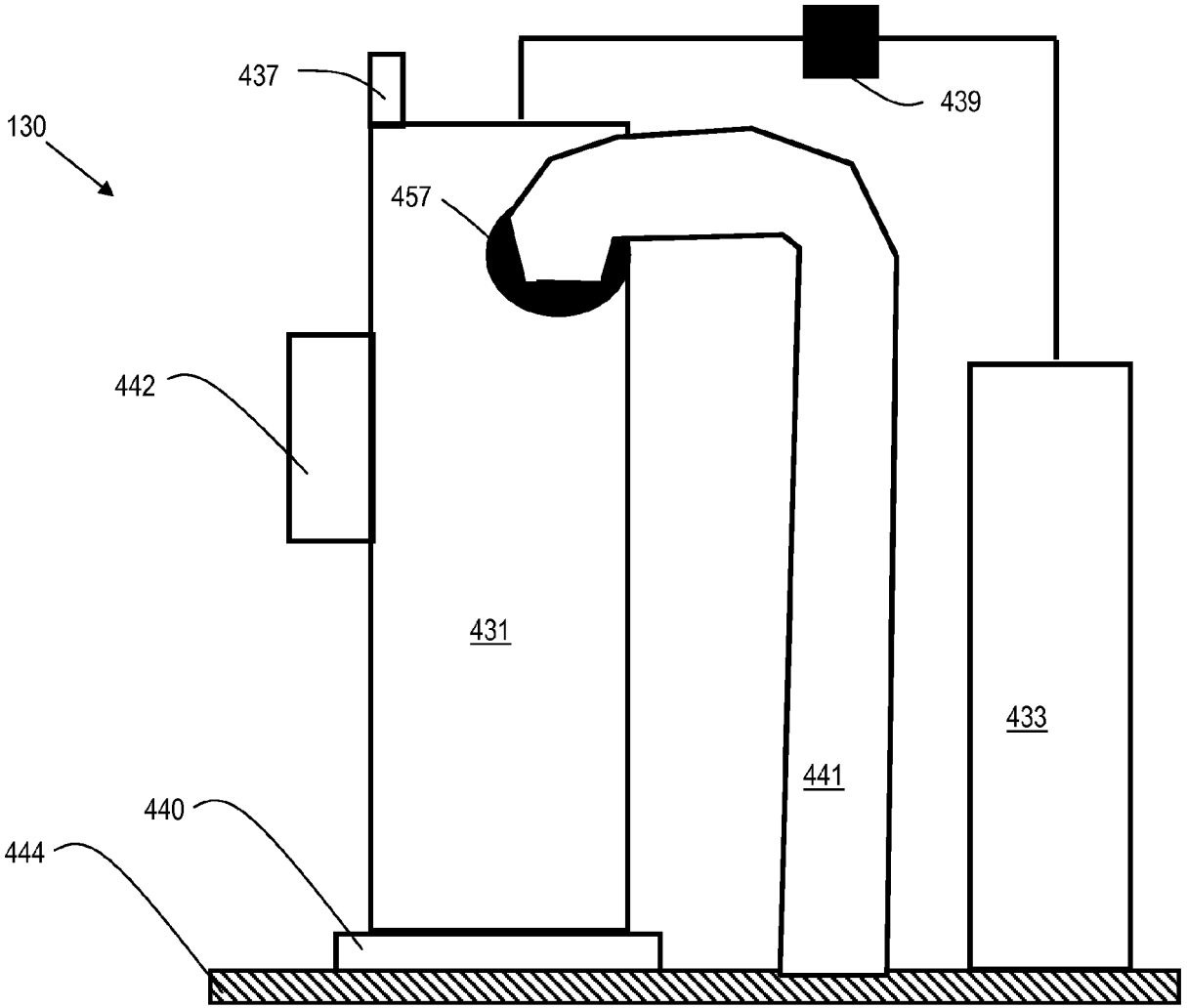
FIG. 5 shows an elevation view of a boiler system employed in an embodiment of the present invention.

FIG. 5 shows a detailed view of boiler system 130. Boiler 431 provides steam which is used to provide hot water for the wet cleaning process. In a preferred embodiment, the boiler uses propane, supplied via tank 240 (FIG. 2). Boiler return tank 433 replenishes water to boiler 431. There are various modifications required to make the boiler system 130 suited for a mobile operation. In particular, the boiler return tank is fitted with a pressure sensor 437. When the pressure falls below a predetermined value, valve 439 is opened to allow pressurized water from the diaphragm water tank 125 (FIG. 3A) to maintain proper water and pressure levels in the return tank 433. The boiler requires constant air intake during normal operation for combustion of the fuel. This can cause very high noise levels. In order to make the environment in the boiler room safe and comfortable for operators, an air trace 441 is used. This air trace 441 draws air from underneath the box 14 of the truck. Boiler control computer 442 controls the replenishing of water into the boiler, and also monitors pressure and temperature at various points. If a pressure or temperature limit is exceeded, the boiler control computer 442 can shut off the boiler automatically. Boiler mounting plate 440 allows the boiler to be safely mounted to the floor 444 of the truck. The mounting plate 440 prevents excess heat from reaching the floor. Air is drawn through air trace 441 via turbo cannon 457 that is mounted at the air input to boiler 431. This provides forced air into boiler 431 for improved combustion. From turbo cannon 457, air trace 441 has a sideward bend, followed by a downward bend, towards the floor, where air trace 441 has an air intake underneath box 14.

Figure 6:
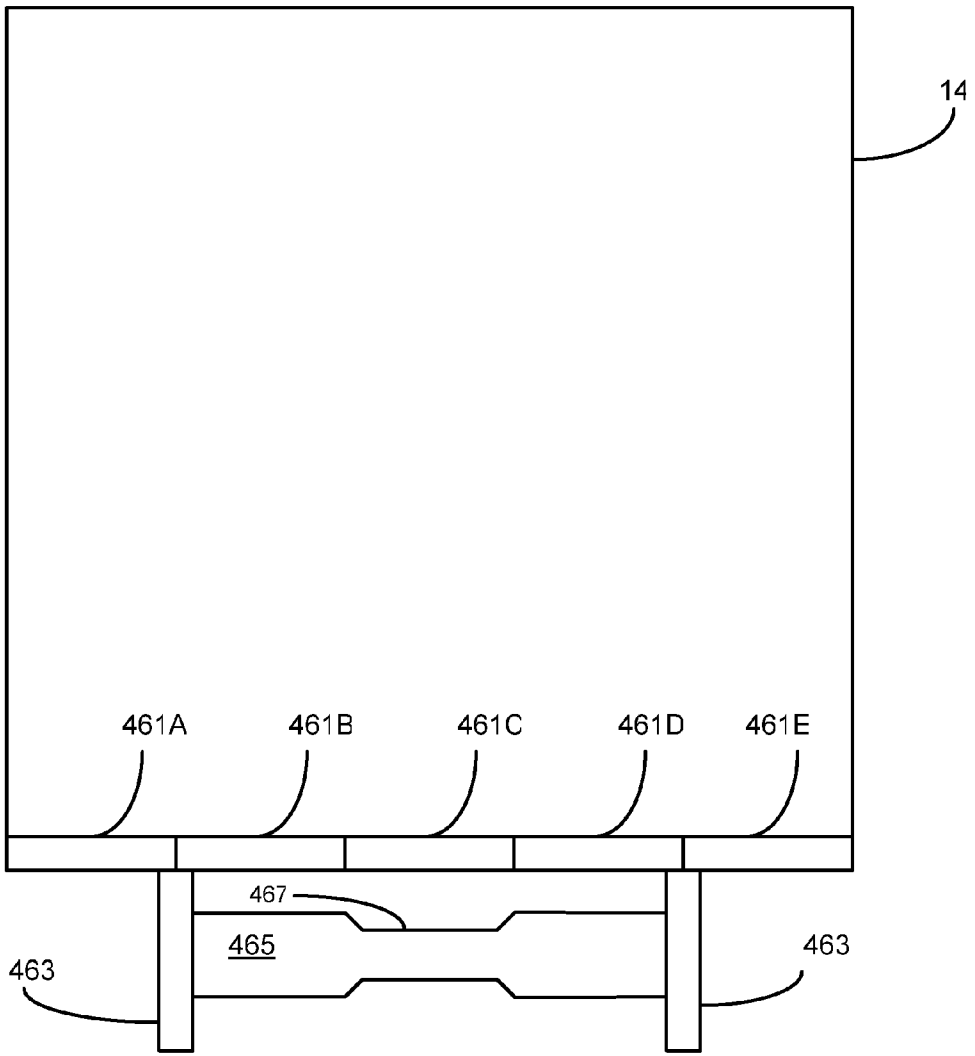
FIG. 6 shows a rear elevation view of a truck embodying the mobile textile treatment of the present invention, indicating vehicle modifications that are well suited for assembling and servicing the mobile textile treatment system of the present invention

FIG. 6 shows a view from the rear of box 14. Typically, box 14 is mounted on a truck chassis, such as the Mitsubishi Fuso FM-MR series. The truck chassis provides a plurality of chassis rails 463, connected by a plurality of cross beams 465. In order to accommodate the plumbing, electric, compressed air, and other needed conduits, a preferred embodiment has a modified chassis. In this embodiment, each cross beam 465 has a conduit groove 467 to allow pipes to be routed therein. Box 14 has a plurality of floor panels 461A, 461B, 461C, 461D, 461E. At least some of the floor panels are removable to facilitate ease of assembly and maintenance. When the mobile cleaning system 10 is being assembled, the plumbing can be assembled or repaired from above by removing floor panel 461C.

The mobile cleaning system 10 of the present invention provides a complete industrial laundry solution in a single vehicle. However, in situations where a higher throughput is desired, the mobile cleaning system is scalable to multiple vehicles. In a preferred multi-vehicle mobile cleaning system, one or more sets of three different trucks (vehicles) are used. One truck is dedicated to wet cleaners, another to drying equipment, such as reclaimers, and the third truck is dedicated to pressing equipment. When more processing throughput is needed, multiples of three trucks can be used. For example, with a nine-truck system, there would be three trucks dedicated to wet cleaners, three for drying equipment, and three for pressing equipment. This method is suitable for handling the textile servicing needs of large institutions such as hospitals, large hotels, and cruise ships. This method is referred to as the "large institution textile servicing method." The fleet of vehicles (trucks) is referred to as a "large institution textile servicing system." This allows a higher throughput for any application requiring a quick turnaround on the processing of their textiles. For example, in the case of a cruise ship, it is desirable to process the textiles quickly so the cruise ship may depart again. For the cruise ship application, and any other application where quick turnaround of textiles is essential, a multi-vehicle mobile cleaning system is contemplated.

Figure 7:
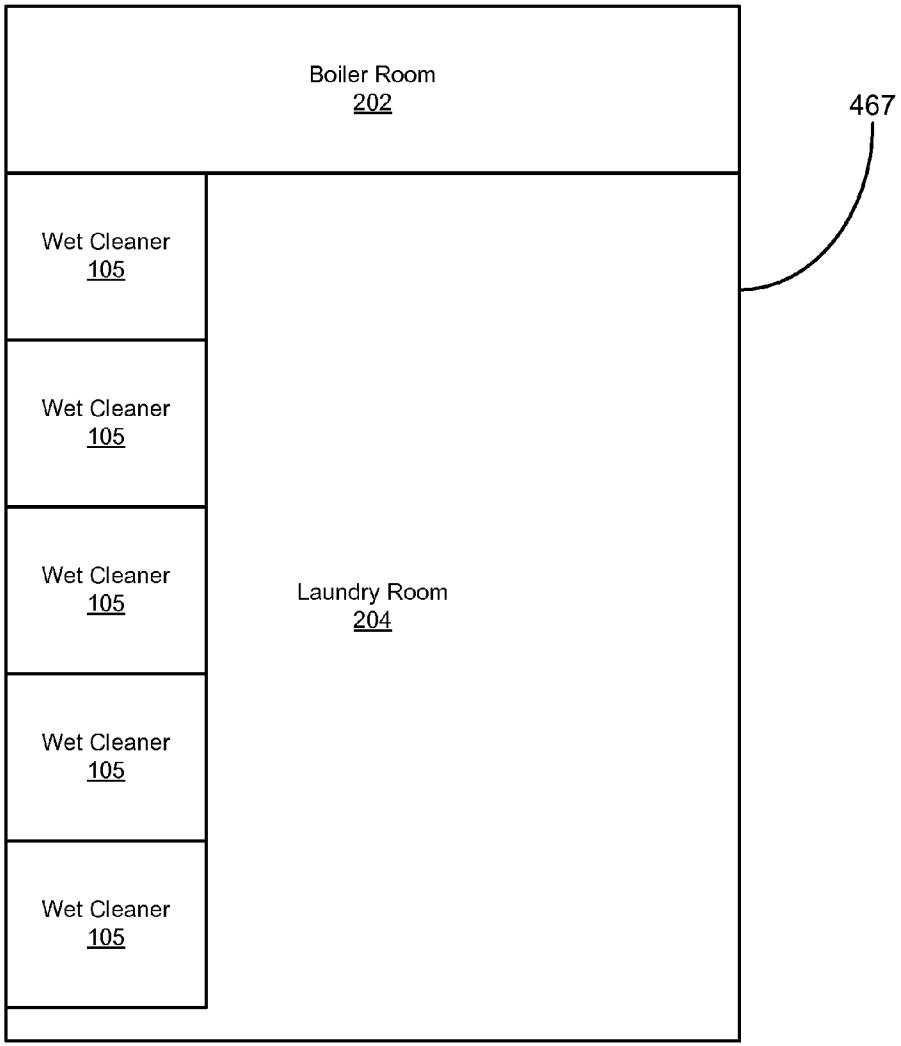
FIG. 7 shows a schematic plan view of a wet cleaner truck suitable for use in a multi-vehicle mobile cleaning system of the present invention.

FIG. 7 shows an arrangement of a wet cleaner truck 467 used in a multi-vehicle mobile cleaning system. Similar to the single vehicle embodiment, each truck of the multi-vehicle mobile cleaning system has a boiler room 202, and laundry room 204. In the laundry room, a plurality of wet cleaners 105 are installed. In an embodiment using a 26 foot box, it is contemplated to have 4 to 6 wet cleaners 105. To accommodate the increased demand for water, the boiler system and diaphragm tank may be of increased capacity from the single vehicle embodiment. For example, in a preferred embodiment of the single vehicle mobile cleaning unit, a 6-hp boiler, such as the Fulton FB-006-A is used. For the wet cleaner truck 467, an 8-hp boiler is contemplated. In a typical embodiment of the single vehicle mobile cleaning unit, a 40-gallon diaphragm tank is used. For a multi-vehicle mobile cleaning system, an 80-gallon tank is contemplated for use in a truck 467.

Figure 8:
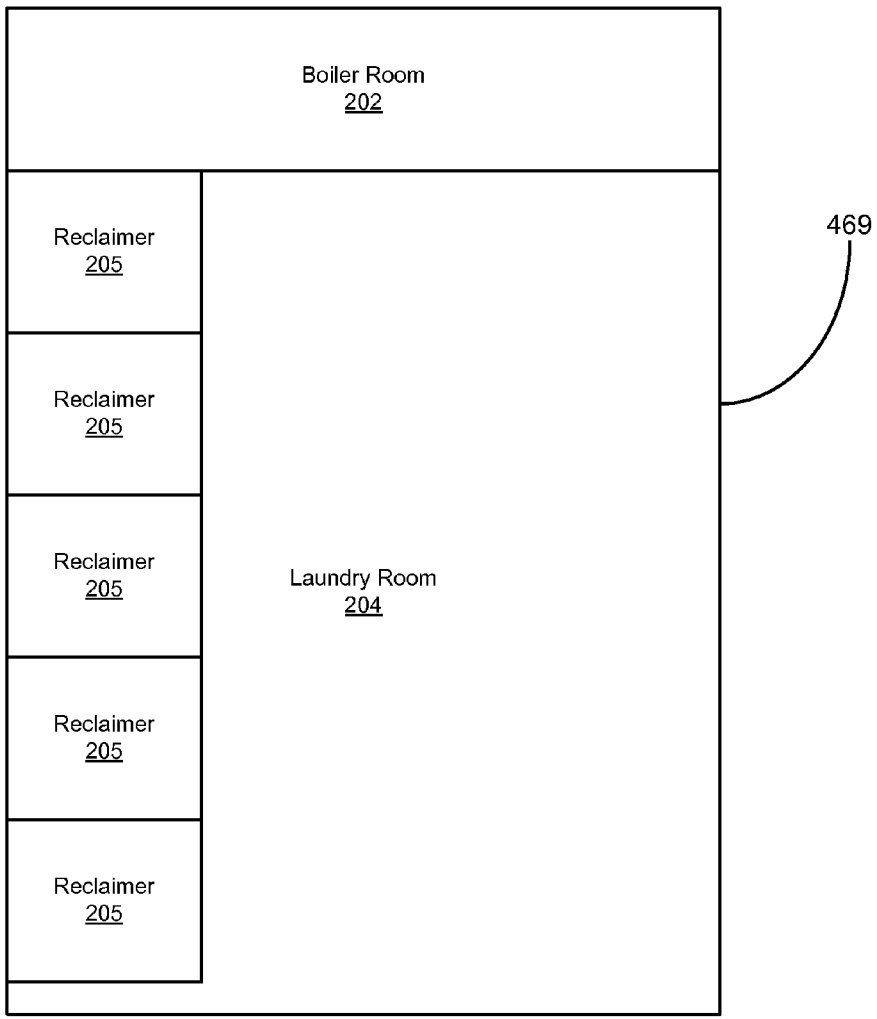
FIG. 8 shows a schematic plan view of a reclaimer truck suitable for use in a multi-vehicle mobile cleaning system of the present invention.

FIG. 8 shows an arrangement of a reclaimer truck 469 used in a multi-vehicle mobile cleaning system. Similar to the single vehicle embodiment, each truck of the multi-vehicle mobile cleaning system has a boiler room 202, and laundry room 204. In the laundry room, a plurality of reclaimer machines 205 are installed.

Figure 9:
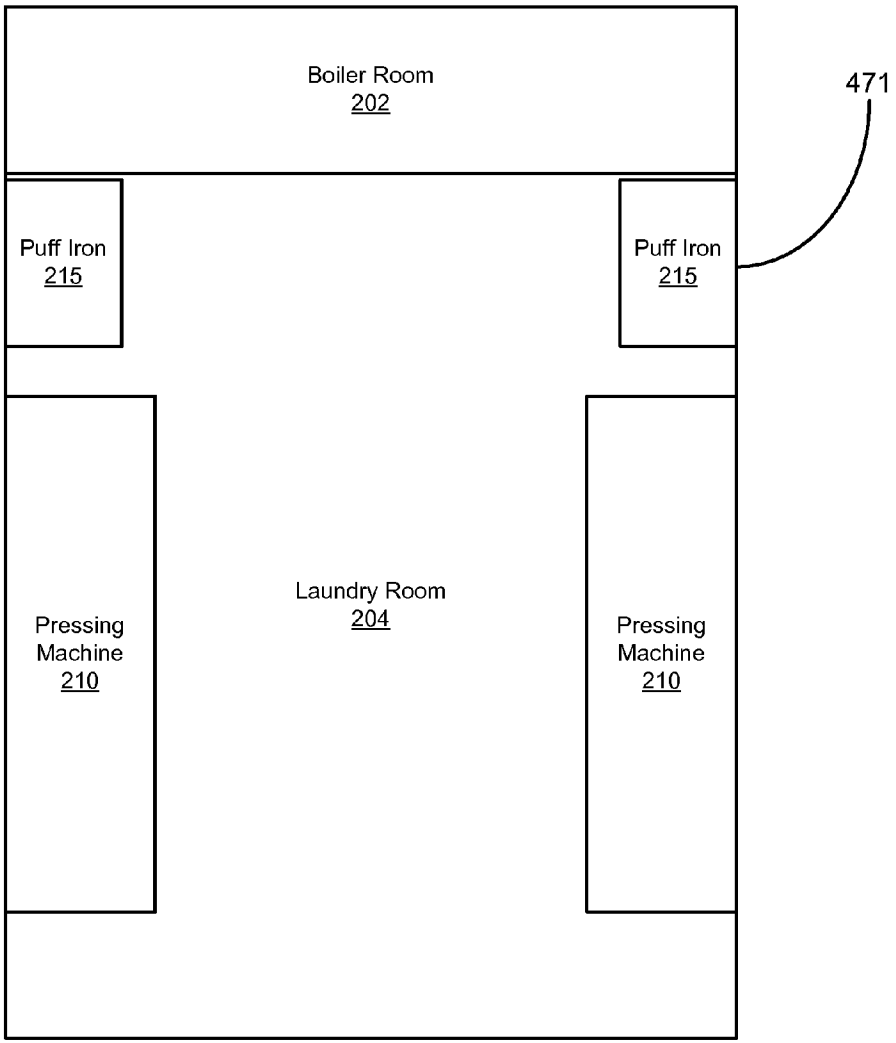
FIG. 9 shows a schematic plan view of a pressing truck suitable for use in a multi-vehicle mobile cleaning system of the present invention.

FIG. 9 shows an arrangement of a pressing truck 471 used in a multi-vehicle mobile cleaning system. Similar to the single vehicle embodiment, each truck of the multi-vehicle mobile cleaning system has a boiler room 202, and laundry room 204. In the laundry room, a plurality of pressing machines 210 and puff irons 215 are installed.

Figure 10:
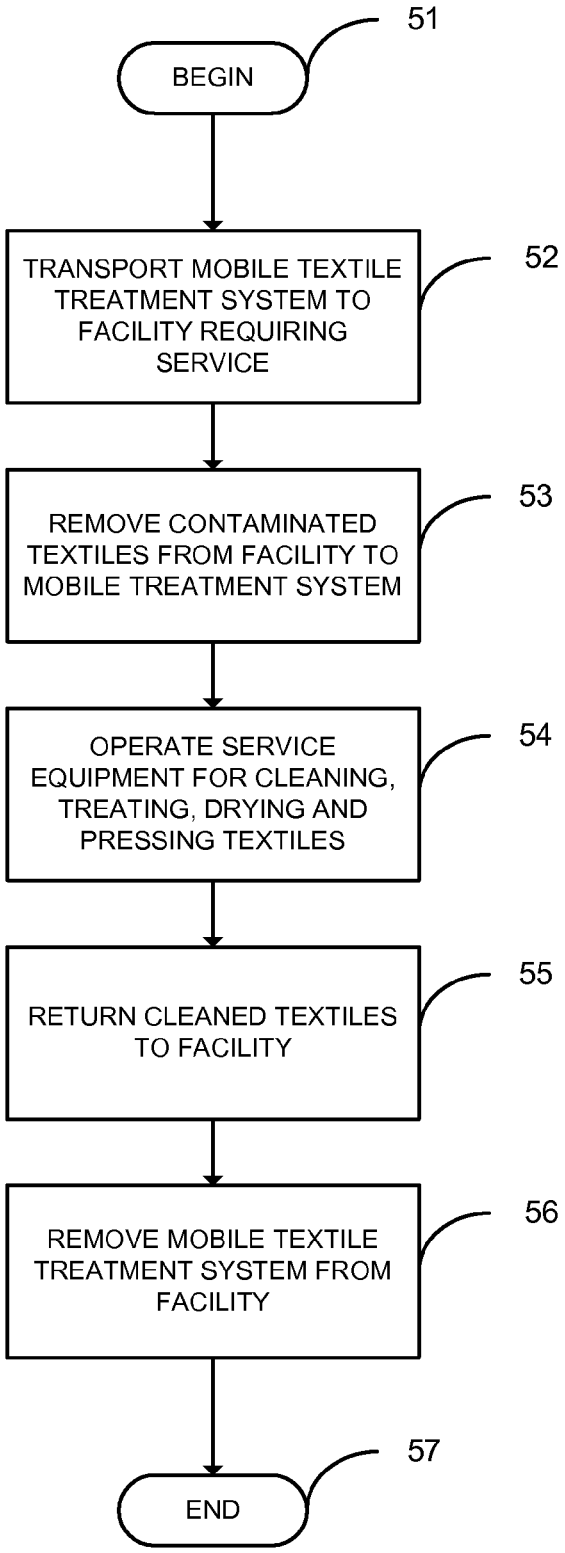
FIG. 10 is a flow diagram providing an overview of logic for servicing contaminated textiles in accordance with the present invention.

FIG. 10 shows a flow diagram providing an overview of logic for servicing contaminated textiles in accordance with the present invention. An exemplary method in accordance with FIG. 10 is discussed in detail with reference to FIG. 11. As shown in FIG. 10, the method starts with transportation of a mobile textile treatment system to the premises of a facility requiring service, as shown in steps 51 and 52. Contaminated textiles requiring service are removed from the facility to the mobile textile treatment system in step 53 and the service equipment for cleaning, treating, drying and pressing is operated as shown in step 54 and is discussed further below with reference to FIG. 11. Once serviced, the cleaned textiles are returned to the facility 55 and the mobile textile treatment system is removed from the premises of the facility to end the process, as shown in steps 56 and 57.

Figure 11:
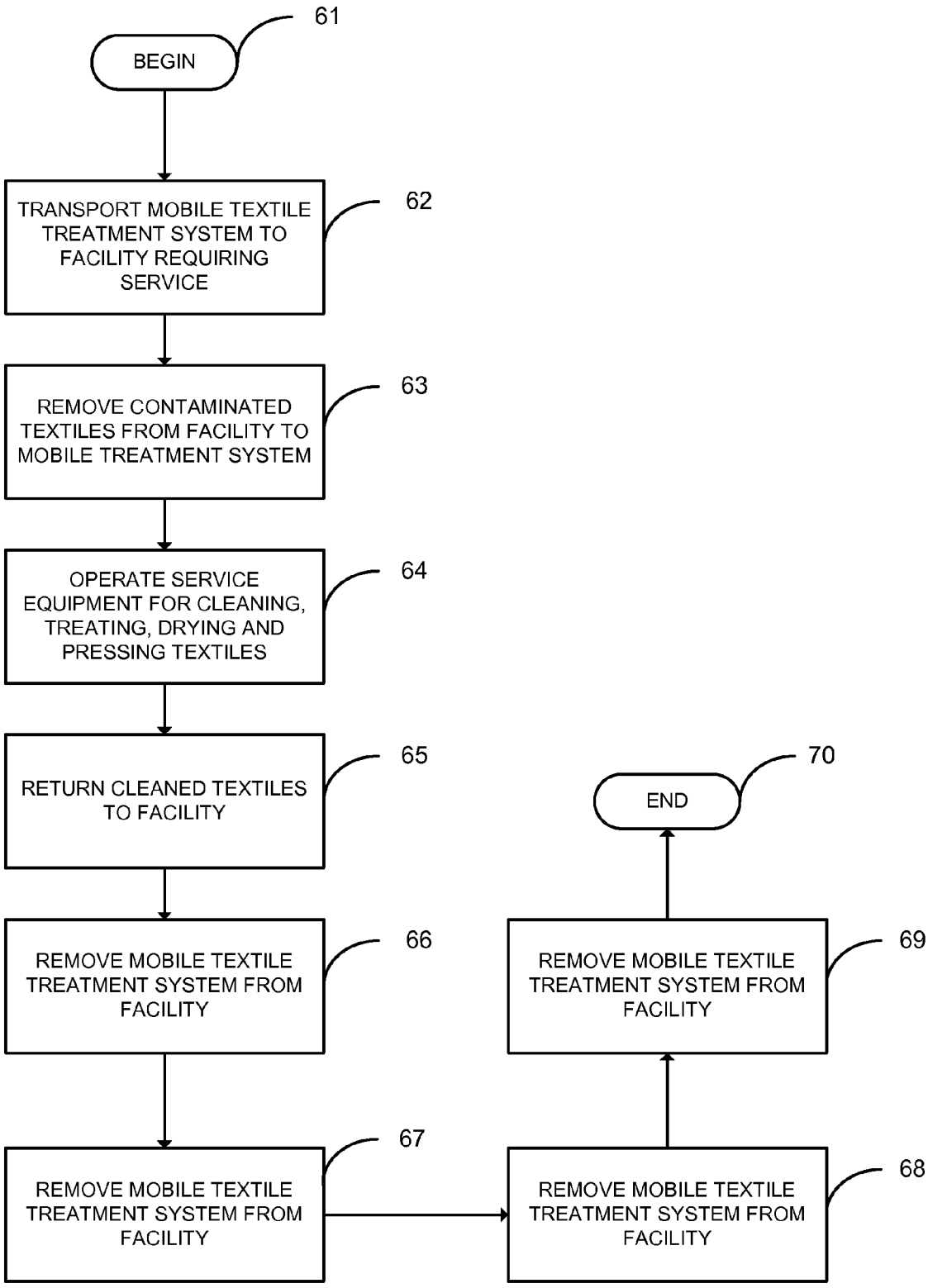
FIG. 11 is a flow diagram providing a detailed view of logic of an exemplary embodiment in accordance with FIG. 10.

FIG. 11 shows a flow diagram providing a detailed view of logic of an exemplary embodiment of step 54 in accordance with FIG. 10. In the example of FIG. 11, the method starts with the weighing of the contaminated textiles to determine weight for proper programming of wet cleaner machine, as shown at steps 61 and 62. Once weighed, the contaminated textiles are loaded into the wet cleaner machine 63 which is programmed for water temperature, drum speed, addition of water and additives 64. The wet cleaner machine is operated to clean and treat the textiles 65. Once the textiles have been cleaned and treated, the water is removed from the wet cleaner machine to the button trap system for reuse to the external sanitary drain, as set forth in step 66. The cleaned and treated textiles are removed from the wet cleaner machine and placed in the reclaimer 67 which is activated to remove moisture from the textiles 68. This part of the process is complete when the cleaned textiles are removed from the reclaimer to the pressing machine and iron, as shown in steps 69 and 70, before returned to the facility as set forth in step 55 of FIG. 10.

For each configuration, the truck suspension should be tuned to the configuration of the vehicle. For example, if the wet cleaners of truck 467 are arranged along the left side as shown in FIG. 7, then the suspension should be adjusted to compensate for the imbalanced load caused by that arrangement. For example, different leaf springs can be used on the right and left side as necessary to compensate in this situation.

Using the three trucks comprising wet cleaner truck 467, reclaimer truck 469 and pressing truck 471, the rate at which textiles can be cleaned dramatically increases. The system is scalable, such that if even more throughput were required, a larger multi-vehicle cleaning system could be assembled. For example, a nine-vehicle mobile cleaning system would have three wet cleaner trucks 467, three reclaimer trucks 469 and three pressing trucks 471. This would be useful in situations such as a natural disaster such as a severe hurricane. As part of the recovery, hospitals would be busier than usual and require quick turnaround of textiles such as cubicle curtains to be cleaned.

Although the invention has been described in detail with particular reference to the above-described specific embodiments, variations and modifications of the present invention for cleaning, treating, drying and pressing contaminated textiles will be apparent to those skilled in the art so as to achieve the same results. It intended that such variations, modifications and equivalents are within the scope of the appended claims.

What is claimed is:

1. A mobile textile treatment system in a vehicle comprising a water intake hose, the water intake hose feeding the input of a water pump, the output of the water pump feeding the input of a water tank, the output of the water tank feeding a cold water input line of a wet cleaner, the output of the water tank also feeding the input of a boiler system, the boiler system having an air input and a water input, the output of the boiler system feeding a hot water input line on the wet cleaner, thereby providing a pressurized water source for filling the wet cleaner of the mobile textile treatment system, wherein the boiler system further comprises a turbo cannon at the air input to the boiler, and the boiler system having an air trace extending from the turbo cannon to the floor of the mobile textile treatment system, whereby air is drawn into the boiler from underneath the vehicle, thereby providing a boiler system that operates at reduced noise levels.

2. The mobile textile treatment system of claim 1, further comprising a water intake filter between the water intake hose and the water pump, thereby filtering the water before it is used for cleaning textiles within the mobile textile treatment system.

3. The mobile textile treatment system of claim 1, wherein the boiler system further comprises a vehicle interlock, thereby preventing driving the vehicle while the boiler system is in use.

4. The mobile textile treatment system of claim 1, wherein the boiler system further comprises a heat exchanger valve for transferring heat from steam from the boiler to water being feed to the hot water input line on the wet cleaner.

5. The mobile textile treatment system of claim 1, further comprising means for adding additives to the wet cleaner during the cleaning process.

6. The mobile textile treatment system of claim 1, further comprising a return system, the return system comprising at least one return tank, and means for returning washing liquid from the wet cleaner to the return system upon completion of a cleaning cycle of the wet cleaner machine, thereby providing for the reuse of washing liquid to the wet cleaner during a subsequent cleaning process.

7. The mobile textile treatment system of claim 6, further comprising a button trap, the button trap being between the wet cleaner and the return system, thereby filtering the washing liquid before the washing liquid is input to the return system.

8. The mobile textile treatment system of claim 1, further comprising a reclaimer.

9. The mobile textile treatment system of claim 1, further comprising a pressing machine.

10. The mobile textile treatment system of claim 1, further comprising a puff iron.

11. A mobile textile treatment system in a vehicle comprising a water intake hose, the water intake hose feeding the input of a water pump, the output of the water pump feeding the input of a water tank, the output of the water tank feeding a cold water input line of a wet cleaner, the output of the water tank also feeding the input of a boiler system, the boiler system having an air input and a water input, the output of the boiler system feeding a hot water input line on the wet cleaner, thereby providing a pressurized water source for filling the wet cleaner of the mobile textile treatment system, wherein the wet cleaner further comprises one or more locking bars, one or more interlock switches, and a plurality of locking ports, whereby the locking bars traverse the locking ports, thereby securing the wet cleaner machine for transport, and said locking bars contact a corresponding interlock switch, the interlocking switch preventing operation of the wet cleaner when the wet cleaner is secured for transport.

12. The mobile textile treatment system of claim 11, further comprising a first computer which monitors a sensor for pressure in a boiler return tank and which activates the opening and closing of a valve located inline with a connection between the water tank and the boiler return tank to maintain pressure and water at desired levels within the boiler return tank and a second computer which controls the input of hot and cold water into the wet cleaner via a hot water intake valve in the hot water input line and a cold water intake valve in the cold water input line, and which controls at least one additive pump, injecting at least one specific additive into the wet cleaner at an appropriate time during a cleaning cycle.

13. The mobile textile treatment system of claim 12, wherein the second computer controls the injection of flame retardant into the wet cleaner through an additive pump.

14. The mobile textile treatment system of claim 12, wherein the second computer controls the injection of a sanitizing composition into the wet cleaner through an additive pump.

* * * * *